US011952540B2

(12) United States Patent
Chang et al.

(10) Patent No.: US 11,952,540 B2
(45) Date of Patent: Apr. 9, 2024

(54) METHOD AND APPARATUS FOR HYDROCRACKING MINERALIZED REFUSE PYROLYSIS OIL

(71) Applicant: East China University of Science and Technology, Shanghai (CN)

(72) Inventors: Yulong Chang, Shanghai (CN); Hualin Wang, Shanghai (CN); Xia Jiang, Shanghai (CN); Jianping Li, Shanghai (CN); Jingyi Zhu, Shanghai (CN); Pengbo Fu, Shanghai (CN); Wei Yuan, Shanghai (CN)

(73) Assignee: East China University of Science and Technology, Shanghai (CN)

( * ) Notice: Subject to any disclaimer, the term of this patent is extended or adjusted under 35 U.S.C. 154(b) by 152 days.

(21) Appl. No.: 17/627,824

(22) PCT Filed: Jun. 16, 2020

(86) PCT No.: PCT/CN2020/096318

§ 371 (c)(1),
(2) Date: Jan. 18, 2022

(87) PCT Pub. No.: WO2021/012838

PCT Pub. Date: Jan. 28, 2021

(65) Prior Publication Data

US 2022/0275282 A1 Sep. 1, 2022

(30) Foreign Application Priority Data

Jul. 19, 2019 (CN) ..... 201910654073.5

(51) Int. Cl.
*B01J 8/24* (2006.01)
*C10G 3/00* (2006.01)

(52) U.S. Cl.
CPC ..... *C10G 3/50* (2013.01); *C10G 3/42* (2013.01); *C10G 2300/1011* (2013.01)

(58) Field of Classification Search
CPC .... C10G 3/42; C10G 3/50; C10G 2300/1003; B01J 8/24
See application file for complete search history.

(56) References Cited

U.S. PATENT DOCUMENTS

| | | | | |
|---|---|---|---|---|
| 4,308,411 | A | 12/1981 | Frankiewicz | |
| 2012/0310023 | A1* | 12/2012 | Huang | C10G 1/002 585/241 |
| 2016/0362609 | A1* | 12/2016 | Ward | C10G 69/02 |

FOREIGN PATENT DOCUMENTS

| | | | | |
|---|---|---|---|---|
| CN | 101020826 | A | 8/2007 | |
| CN | 101402874 | A | 4/2009 | |
| CN | 106554789 | A | 4/2017 | |
| CN | 108026450 | A | 5/2018 | |
| CN | 110330996 | A | 10/2019 | |
| WO | WO-0105908 | A1 * | 1/2001 | C10G 1/002 |

OTHER PUBLICATIONS

S. Bezergianni et al., Alternative Diesel from Plastics, 10 Energies 1-12 (2017).*
G. C. Faussone, Transportation Fuel From Plastic: Two Cases of Study, 73 Waste Management 416-423 (2018).*
P. A. Owusu et al., Reverse Engineering of Plastic Waste Into Useful Fuel Products, 130 J. Anal. Appl. Pyrolysis 285-293 (2018).*
China National Intellectual Property Administration, International Search Report and Written Opinion in Application No. PCT/CN2020/096318, dated Sep. 23, 2020, 11 pages, Beijing, China.

* cited by examiner

*Primary Examiner* — Randy Boyer
(74) *Attorney, Agent, or Firm* — Marshall & Melhorn, LLC

(57) ABSTRACT

A method and apparatus for hydrocracking mineralized refuse pyrolysis oil. The method may use the following steps: (a) crushing and pyrolyzing mineralized refuse to obtain arene and alkane precursor biomass oil; (b) hydrogenating the arene and alkane precursor biomass oil obtained in step (a), and separating the obtained hydrocrackate to obtain arene and alkane; and (c) purifying, recovering and optimizing the arene and alkane obtained in step (b), and performing deep processing to produce naphtha, jet fuel, light diesel oil, and heavy diesel oil.

9 Claims, 1 Drawing Sheet

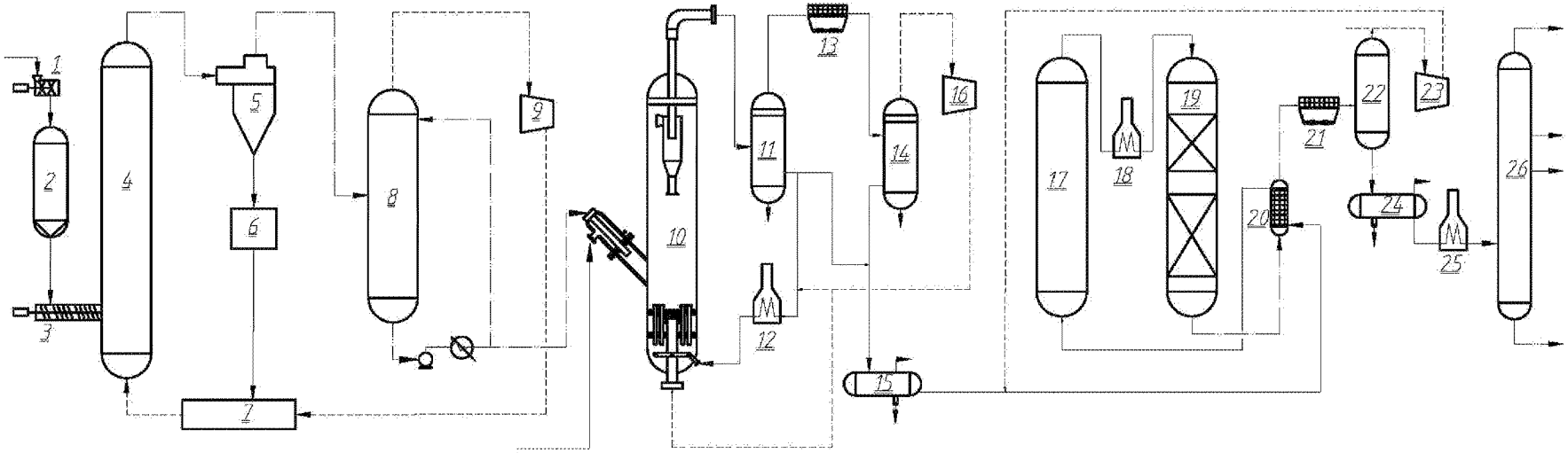
1
2
3
4
5
6
7
8
9
10
11
12
13
14
15
16
17
18
19
20
21
22
23
24
25
26

METHOD AND APPARATUS FOR HYDROCRACKING MINERALIZED REFUSE PYROLYSIS OIL

TECHNICAL FIELD

The present disclosure pertains to the field of mineralized refuse recycling, and relates to a method and apparatus for combined treatment of reclaimed mineralized refuse by screening, pyrolysis and hydrocracking. Specifically, the present disclosure relates to a method for recovering an oil product by hydrogenation with the use of a crusher, a screw feeder, a fluidized bed pyrolyzer, a boiling bed reactor and a fixed bed reactor integrated in series, and an apparatus for implementing the method.

BACKGROUND ART

Along with the rapid development of China's economy and the accelerated urbanization, the amount of domestic waste is also rising. According to "2017 Annual Report on Prevention and Control of Solid Waste Pollution to Environment in Large and Medium-sized Cities in China" published by the Ministry of Ecology and Environment of the People's Republic of China, 188.505 million tons of domestic waste was generated in 214 large and medium-sized cities in 2016, and 186.844 million tons of the domestic waste was disposed. The disposal rate was 99.1%. Among the 214 large and medium-sized cities, Shanghai is the city where the largest amount of municipal solid waste was produced, namely 8.799 million tons, followed by Beijing, Chongqing, Guangzhou and Shenzhen, producing 8.726 million tons, 6.929 million tons, 6.884 million tons and 5.723 million tons, respectively. The total amount of municipal solid waste produced in the top 10 cities was 56.512 million tons, accounting for 30% of the total amount of the municipal solid waste produced in all the cities having the information released. Landfill disposal is still the most important way for municipal solid waste disposal in China, supplemented by other disposal ways such as incineration and composting. The advantages include saving of time, expense, and labor. With a large number of sanitary landfills built in China, the amount of waste buried in the landfill areas is also rising, and the amount of mineralized refuse is rising correspondingly.

Mineralized refuse means that the landfill age is 8-10 years or more (10-15 years or more in the northern region); the surface settlement is less than 10 mm/year; the content of organic matter in the waste is less than 10%; and the easily degradable substances are completely or nearly completely degraded. In addition, the waste itself hardly produces leachate, landfill gas or unpleasant odor, and the landfill reaches a steady state, i.e. a harmless state. The waste at this point is called mineralized refuse. Mineralized refuse has the advantages of high porosity, large surface area, high nutrient content, and rich microorganisms. The excavation and resource utilization of mineralized refuse in landfills can not only recover recyclable components, but also free up landfill space to realize dynamic circulation of the storage capacity of the landfills. In view of the scale of landfills in China, a huge amount of mineralized refuse is stored. Therefore, the excavation of mineralized refuse is of great significance for finding an ultimate destination for waste and reducing the land resources occupied by buried waste.

At present, mineralized refuse is separated mainly by adopting traditional separation technologies in agriculture, mining and other fields. The wind screening technology, vibrating screening technology and drum screening technology are utilized to purify the dominant minerals. Due to the complex composition and high moisture content of domestic waste, the recyclable components in the waste cannot be separated with a good effect, and some foreign equipment is not adaptable to the waste in China.

Chinese Patent Application CN101376834 discloses a boiling bed combined process. US Patent Application U.S. Pat. No. 6,620,311 describes a combined process including steps of boiling bed hydrogenation, separation, hydrodesulfurization, and catalytic cracking to process petroleum fractions. US Patent Application U.S. Pat. No. 6,447,671 describes a combined process including boiling bed hydrogenation-catalyst solid separation-fixed bed hydrogenation. Although the above patent applications have achieved certain effects, they face some tough problems in common, such as difficulty in guaranteeing the hydrogenation conditions in a subsequent fixed bed reactor, and unreasonability in energy utilization and practical industrial application value.

In short, due to various problems in the existing technologies, there has not yet been a mature system and technical method so far for scientifically, and reasonably processing mineralized refuse. The expectations and requirements of industrialized processing of mineralized refuse are far from being satisfied. Therefore, in view of the above shortcomings of the prior art, there is an urgent need in the art to develop a method and apparatus for hydrocracking of mineralized refuse cracked oil with reasonable energy utilization and a compact process flow.

SUMMARY

The present application provides a novel, efficient and environmentally-friendly method and apparatus for hydrocracking mineralized refuse pyrolysis oil, with an intention to solve the problems caused by the huge storage of mineralized refuse in China currently, and provide a new concept for treating mineralized refuse and reducing environmental pollution caused by incineration of mineralized refuse. The resource utilization of rural mineralized refuse can not only recover recyclable components, but also free up space for planting crops, thereby developing a desirable dynamic cycle.

The present application has solved some problems in the prior art, so that the environment polluted due to incineration of mineralized refuse for many years can be improved. While extremely considerable economic benefits can be achieved, the environmental and social benefits can also be enhanced greatly. It is of great significance to the reuse of land resources. Research on the development and utilization of mineralized refuse is also one of the important subjects of sustainable development technologies in China.

In one aspect, the present application provides a method for hydrocracking mineralized refuse cracked oil, comprising the following steps:

(a) Crushing and pyrolyzing mineralized refuse to obtain an arene-and-alkane precursor biomass oil;

(b) Hydrogenating the arene-and-alkane precursor biomass oil obtained in step (a) to obtain a hydrocracking product which is separated to obtain arenes and alkanes; and (c) Recovering, purifying, optimizing and deeply processing the arenes and alkanes obtained in step (b) to produce naphtha, jet fuel, light diesel oil and heavy diesel oil.

In a preferred embodiment, in step (a), the mineralized refuse is stable mineralized refuse having an organic matter content of 9-15 wt % on a solid basis of the mineralized refuse, an ion exchange capacity of 50-150 mEq/100 g dry refuse, and a pH of 6-8.

In another preferred embodiment, in step (a), the mineralized refuse is crushed with a crusher to recover biomass particles which enter a fluidized bed pyrolyzer through a screw feeder for hydrolysis, wherein a light phase is discharged from a top of the fluidized bed pyrolyzer after the pyrolysis, and then subjected to gas-solid separation in a gas-solid cyclone separator, wherein gas is discharged from an overflow port of the gas-solid cyclone separator, and residual pyrolyzed carbon is heated by a heating furnace to provide heat. In another preferred embodiment, the treatment of step (a) can recover 45% compostable matter having a purity of 97% or more, 20% compostable matter having a purity of 70-80 wt %, and 25% plastic having a purity of 80% or more.

In another preferred embodiment, the gas discharged from the overflow port of the gas-solid cyclone separator is cooled and liquefied in a quench tower to generate the arene-and-alkane precursor biomass oil.

In another preferred embodiment, in step (b), the hydrogenation is carried out in a boiling bed reactor and a fixed bed reactor combined in series.

In another preferred embodiment, in step (b), the hydrocracking product obtained is separated into alkanes and arenes by high-pressure separation and low-pressure separation.

In another preferred embodiment, in step (c), the alkanes and arenes obtained in step (b) are recovered, purified and optimized by high-pressure separation and low-pressure separation, and then pass through a heating furnace to a rectification tower for deep processing to form naphtha, jet fuel, light diesel oil and heavy diesel oil.

In another aspect, the present disclosure provides an apparatus for hydrocracking mineralized refuse cracked oil, comprising:

A crusher and a fluidized bed pyrolyzer in communication with the crusher, used to perform step (a): crushing and pyrolyzing mineralized refuse to obtain an arene-and-alkane precursor biomass oil;

A boiling bed reactor in communication with the fluidized bed pyrolyzer, and two-stage fixed bed reactors in communication with the boiling bed reactor, used to perform step (b): hydrogenating the arene-and-alkane precursor biomass oil obtained in step (a) to obtain a hydrocracking product which is separated to obtain arenes and alkanes; and A cold high-pressure separator in communication with the two-stage fixed bed reactors, a cold low-pressure separator in communication with the cold high-pressure separator, and a rectification tower in communication with the cold low-pressure separator, used to perform step (c): recovering, purifying, optimizing and deeply processing the arenes and alkanes obtained in step (b) to produce naphtha, jet fuel, light diesel oil and heavy diesel oil.

In a preferred embodiment, the apparatus further comprises: a material tank, of which an upper part is communicated with the crusher and a lower part is communicated with the fluidized bed pyrolyzer through a screw feeder, for collecting crushed mineralized refuse, wherein the screw feeder has an installation angle of 4.3°-6.0°, and a ratio of a rotation speed to a limit rotation speed is 0.4-0.6;

A gas-solid cyclone separator in communication with the fluidized bed pyrolyzer, used for gas-solid separation of a light phase obtained after pyrolysis in the fluidized bed pyrolyzer; a quench tower in communication with an upper part of the gas-solid cyclone separator, used for cooling and liquefying a gas discharged from an overflow port of the gas-solid cyclone separator to form an alkane-and-arene precursor biomass oil; and a separation tank in communication with a lower part of the gas-solid cyclone separator, used for collecting residual pyrolyzed carbon;

A heating furnace in communication with a lower part of the separation tank, used for heating the residual pyrolyzed carbon and non-condensable gas sent from a compressor in communication therewith to supply heat to the fluidized bed pyrolyzer in communication therewith, wherein an upper part of the quench tower is communicated with the heating furnace through the compressor, and the quench tower cools and liquefies the resulting alkane-and-arene precursor biomass oil which is then sent to the boiling bed reactor in communication therewith for hydrogenation reaction;

A hot high-pressure separator and a heating furnace in communication with the boiling bed reactor, wherein the hot high-pressure separator and the heating furnace are communicated with each other; an air cooler in communication with the hot high-pressure separator; a cold high-pressure separator in communication with the air cooler; a compressor in communication with the cold high-pressure separator and the heating furnace; a cold low-pressure separator in communication with the hot high-pressure separator and the cold high-pressure separator; and a heat exchanger in communication with the cold low-pressure separator, wherein the hot high-pressure separator, the cold high-pressure separator and the cold low-pressure separator are used for separating the hydrocracking product obtained in the boiling bed reactor to obtain arenes and alkanes, and wherein the heating furnace is used for heating circulating oil in the boiling bed reactor;

A heating furnace disposed between the two-stage fixed bed reactors, wherein the heat exchanger is communicated with the two-stage fixed bed reactors, respectively; an air cooler in communication with the heat exchanger; a cold high-pressure separator in communication with the air cooler; and a cold low-pressure separator in communication with the cold high-pressure separator which is communicated with a heating furnace, wherein the cold high-pressure separator is communicated with the two-stage fixed bed reactors through the heating furnace; and A heating furnace disposed between the cold low-pressure separator and a rectification tower.

Beneficial Effects:

The advantages of the method and apparatus for hydrocracking mineralized refuse pyrolysis oil according to the present application include:

a) It's easy to maintain the apparatus; no waste is generated; the operating cost is low; and the process flow is very compact;
b) The reliability is high; the service life is long; the overall equipment can run continuously for a long time; and the equipment has a long service life;
c) The apparatus has a simple structure, a small footprint, a low failure rate, a small pressure loss, a high separation efficiency, and it's easy to implement and convenient to operate, suitable for long-period operation; and
d) The waste screening has high recycle efficiency. The recycling of the catalyst and the excess hydrogen in the hydrogenation process enhances the overall utilization rate of the catalyst and hydrogen in the entire process, which greatly reduces the investment cost and energy consumption, producing significant effects of energy saving and emission reduction, as well as technical and economic effects. Not only efficient recovery of useful components in mineralized refuse is achieved, but the recovered oil product also meets the use requirements, thereby fully realizing comprehensive and efficient utilization of mineralized refuse.

Compared with the prior art, the present invention can not only crack non-degradable plastic articles, but also has good ability to pyrolyze plastics, rubber, chemical fiber, and biomass. The apparatus of the present invention does not generate secondary pollution, operates steadily and conveniently, and produces good comprehensive economic benefits.

DESCRIPTION OF THE DRAWING

The accompanying drawings are provided for better understanding of the disclosure. They constitute a part of the specification for further explanation of the disclosure without limiting the disclosure.

FIG. 1 is a process flow chart of hydrocracking of mineralized refuse cracked oil according to a preferred embodiment of the present invention.

DETAILED DESCRIPTION

After extensive and intensive research, the inventors of the present application have found that, for separation of mineralized refuse, traditional separation technologies used in the fields of agriculture and mining are mainly employed at present. As traditional separation technologies, wind, vibrating screening and drum screening technologies are used to purify the dominant minerals in mineral sources. However, due to the complex composition and high moisture content of domestic waste, the recyclable components in the waste cannot be separated with a good effect, and some foreign equipments are not adaptable to the waste in China.

In view of the above-mentioned defects in the prior art, the method of the present application processes the mineralized refuse that has been excavated with a crusher, a fluidized bed, a cyclone separator, and the like to obtain an arene-and-alkane precursor cracked oil. A series combination of a boiling bed and a fixed bed is employed to strengthen the hydrogenation process to realize hydrogenation of the biomass oil. After high-pressure separation and low-pressure separation, arenes and alkanes are obtained. At the same time, a rectification tower is used to separate oil residue. Finally, a high-pressure separation tank and a low-pressure separation tank are used for recovery, purification and high-quality optimization, and the rectification tower is used as appropriate for deep processing to produce naphtha, jet fuel, light diesel oil and heavy diesel oil. As a result, the comprehensive utilization rate of the waste can be improved effectively, and a large amount of land resources occupied by garbage storage can be restored gradually. The technical and economic benefits are significant, and the environmental and social benefits are also promoted greatly.

The apparatus for hydrocracking mineralized refuse cracked residual oil according to the present application can be widely used in applications where the cracked residual oil derived from mineralized refuse is to be hydrocracked. It can effectively solve the problem of continuous accumulation of mineralized refuse. While considerable economic benefits of reclamation are guaranteed, it can also gradually restore a large amount of land resources occupied by storage of mineralized refuse. So, it is of great strategic significance.

The technical concept of the present invention is as follows:

Firstly, the crackable components screened from the crusher form cracked components in the fluidized bed pyrolyzer. The cracked components are further purified and separated by the selected gas-solid cyclone separator at the top of the tower. The non-degradable residue is discharged and recovered from the bottom of the tower. In the entire hydrocracking process of the mineralized refuse cracked oil, the key is that the crackable components are preheated and sent to the fluidized bed pyrolyzer for cracking, and the core is that boiling bed hydrogenation and fixed bed hydrogenation are combined in series to achieve separation of oil and ash. The residual oil purified preliminarily by cyclone separation passes through a rectification tower to separate the oil phase out. After the oil phase is reacted in the boiling bed reactor, it enters the fixed bed reactor. After the reaction is complete, it enters a hot high-pressure separation tank to achieve separation of the oil and the residue. After the hydrogenation reaction, the excess hydrogen is recycled, which enhances the comprehensive utilization rate of the catalyst and hydrogen in the entire process, thereby greatly reducing the investment cost and energy consumption. Subsequently, the oil product from the top of the hot high-pressure separation tank continues to receive deep processing by cold high-pressure separation and cold low-pressure separation, while the residue from the bottom of the tank is cyclically hydrogenated or recycled depending on its quality, and selection is made according to the quality of the feed to the cracking furnace, so as to enhance the comprehensive utilization rate of the mineralized refuse.

The above-mentioned technical concept of the present invention can be realized in the following way:

A series combination of a boiling bed reactor and a fixed bed reactor is used in the hydrogenation process to strengthen hydrogenation, and the catalyst discharged from the boiling bed reactor is purified and recovered by micro-cyclone drying and reduction.

The cyclone separator is small in size, light in weight, and fast in processing speed. It is a novel, high-efficiency, energy-saving, and economical separation device suitable for long-term operation. It can further purify and separate the cracked components from the top of the fluidized bed pyrolyzer.

The experimental devices applicable to the present invention are not particularly limited, and their specific structures can be determined according to the overall requirements of the process. Among them, the cyclone separator may be a gas-solid cyclone separator, a gravity settling tank, etc., with a gas-solid cyclone separator being preferred; and the number of the micro-cyclone separation core tube may be one or more.

The method and apparatus for hydrocracking mineralized refuse cracked oil according to the present invention can also be used for recycling other materials comprising recyclable components such as compostable materials, plastics, rubber, and chemical fibers.

In a first aspect, the present disclosure provides a method for hydrocracking mineralized refuse cracked oil, comprising:

(a) Excavating mineralized refuse which is crushed with a crusher and pyrolyzed with a fluidized bed to obtain an arene-and-alkane precursor biomass oil;

(b) Hydrogenating the biomass oil with a boiling bed and a fixed bed combined in series, followed by high-pressure separation and low-pressure separation to obtain arenes and alkanes; and (c) Using a high-pressure separation tank and a low-pressure separation tank to perform purification, recovery, and high-quality optimization, and using a rectification tower as appropriate to perform deep processing to produce naphtha, jet fuel, light diesel oil and heavy diesel oil.

Preferably, the method comprises: Naturally drying the mineralized refuse purchased commercially for an appropriate period of time, crushing it appropriately depending on the degree of compaction of the refuse, and then sending it to a stock bin for screening and sorting of crackable components such as wood fiber;

Gasifying the recyclable refuse components by a rapid pyrolysis process, and removing the solid residue from the product by cyclone separation;

Using a hydrogenation process with a boiling bed and a fixed bed combined in series to hydrogenate the residual oil; and Sending the hydrogenated residual oil, after the reaction is complete, to a hot high-pressure separation tank to separate the oil from the residue, wherein the excess hydrogen is recycled, wherein the oil product from the top of the hot high-pressure separation tank continues to receive deep processing by cold high-pressure separation and cold low-pressure separation, while the residue from the bottom of the tank is cyclically hydrogenated or recycled depending on its quality, and selection is made according to the quality of the feed to the cracking furnace.

In the present disclosure, the mineralized refuse is stable mineralized refuse having an organic matter content of 9-15 wt % on a solid basis of the mineralized refuse, an ion exchange capacity of 50-150 mEq/100 g dry refuse, and a pH of 6-8.

In the present disclosure, in step (a), the mineralized refuse is crushed with a crusher to recover biomass particles which enter a fluidized bed pyrolyzer through a screw feeder for hydrolysis, wherein a light phase may be discharged from a top of the fluidized bed pyrolyzer after the pyrolysis under the effect of an blower, and then subjected to gas-solid separation in a gas-solid cyclone separator, wherein gas is discharged from an overflow port of the gas-solid cyclone separator, and residual carbon formed in the pyrolysis is heated by a heating furnace to provide heat.

In the present disclosure, in step (a), the screening of the refuse can recover 45% compostable matter having a purity of 97% or more, 20% compostable matter having a purity of 70-80 wt %, and 25% plastic having a purity of 80% or more.

Preferably, before the hydrogenation reaction of the crackable component, a gas-solid cyclone separator is used for preliminary separation and purification to ensure the effect of the subsequent hydrogenation reaction.

In the present disclosure, in step (a), the mixed gas discharged from the overflow port of the gas-solid cyclone separator is cooled and liquefied by a quench tower to generate the alkane-and-arene precursor.

In the present disclosure, in step (b), the hydrogenation is carried out in a boiling bed reactor and a fixed bed reactor combined in series.

In the present disclosure, in step (b), the hydrocracking product from the boiling bed reactor and the fixed bed reactor is separated by high-pressure separation and low-pressure separation to produce alkanes and arenes.

In the present disclosure, in step (c), the alkanes and arenes are deeply optimized by high-pressure separation and low-pressure separation, and then pass through a heating furnace to a rectification tower for deep processing to produce naphtha, jet fuel, light diesel oil and heavy diesel oil.

In a second aspect, the present disclosure provides an apparatus for hydrocracking mineralized refuse cracked oil, comprising:

A crusher and a fluidized bed pyrolyzer in communication with the crusher for performing step (a) as described above;

A boiling bed reactor in communication with the fluidized bed pyrolyzer, and two-stage fixed bed reactors in communication with the boiling bed reactor, for performing step (b) as described above; and A cold high-pressure separator in communication with the two-stage fixed bed reactors, a cold low-pressure separator in communication with the cold high-pressure separator, and a rectification tower in communication with the cold low-pressure separator, for performing step (c) as described above.

Preferably, the apparatus comprises:

A crusher for recovering usable components of mineralized refuse, wherein the crushed mineralized refuse is collected into a material tank, and then sent by a screw feeder to a fluidized bed pyrolyzer for carbonization of organic matter; wherein the fixed carbon and ash collected after the pyrolysis fall into a separation tank; wherein, after separation, the pyrolyzed carbon and the non-condensable gas from a compressor are sent together to a heating furnace for combustion; wherein the combustion heat is used to supply heat to the fluidized bed pyrolyzer; wherein, after the pyrolysis, the light phase components are sent to a gas-solid cyclone separator; wherein the resulting gas phase passes through a quench tower to obtain an alkane-and-arene precursor which enters a boiling bed reactor together with dilution oil to undergo hydrogenation reaction; wherein, after the boiling bed reaction, the three phases are separated by a three-phase separator, and the reaction product enters a hot high-pressure separator, an air cooler, a cold high-pressure separator, and a cold low-pressure separator to separate partially hydrogenated arenes and alkanes; wherein circulating oil passes through the hot high-pressure separator and enters a heating furnace together with circulating hydrogen from the compressor to be heated, and then returns to the boiling bed reactor; wherein the partially hydrogenated arenes and alkanes pass through a heat exchanger for heat exchange, and then enter two-stage fixed bed reactors in sequence for hydrocracking reaction again; wherein a heating furnace is disposed between the two-stage fixed bed reactors; wherein the reaction product passes through the heat exchanger, enters an air cooler, then enters a cold high-pressure separator, a cold low-pressure separator and a heating furnace, and then enters a rectification tower to separate naphtha, jet fuel, light diesel oil and heavy diesel oil; wherein the circulating hydrogen from the cold high-pressure separator is heated in a heating furnace, and then recycled to the fixed bed reactor for recycling.

In the present disclosure, the fluidized bed pyrolyzer in communication with the screw feeder is used to fluidize the recyclable refuse components at high temperature via a rapid high temperature process, and the solid residue in the product is separated by the gas-solid cyclone separator and burned in the heating furnace to provide heat to the fluidized bed.

In the present disclosure, the quench tower in communication with the cyclone separator cools the gas phase overflowing from the cyclone separator. The gas phase passes through a pump, and is heated by a heat exchanger and then sent to the boiling bed reactor. The non-condensable gas at the upper outlet of the quench tower is introduced into the bottom inlet of the fluidized bed through a compressor.

In the present disclosure, the boiling bed reactor in communication with the heat exchanger is used to hydrocrack the biomass oil. The overflow product from the three-phase separator in the boiling bed passes through the hot high-pressure separator, the cold high-pressure separator, and the cold low-pressure separator to form arenes and alkanes.

In the present disclosure, the heating furnace in communication with the hot high-pressure separator heats the circulating oil for the boiling bed to optimize the hydrogenation process.

In the present disclosure, the oil phase and gas phase produced in the fixed bed reactor in communication with the cold low-pressure separator are subjected to deep processing by high-pressure separation and low-pressure separation, heated, and then rectified to produce naphtha, jet fuel, light diesel oil and heavy diesel oil.

In the present disclosure, the installation angle of the screw feeder is set to 4.3° to 6.0°, and the ratio of the rotation speed to the limit rotation speed is 0.4 to 0.6.

In the present disclosure, a hot high-pressure separation tank and a rectification tower are selected to separate the light phase and the heavy oil residue in the hydrogenated oil product.

Reference will be now made to the accompanying drawings.

FIG. 1 is a process flow chart of hydrocracking of mineralized refuse cracked oil according to a preferred embodiment of the present invention. As shown in FIG. 1, mineralized refuse is crushed by a crusher 1, collected into a material tank 2, and then sent by a screw feeder 3 to a fluidized bed pyrolyzer 4 for carbonization of organic matter. The fixed carbon and ash collected after the pyrolysis fall into a separation tank 6. After separation, the pyrolyzed carbon and the non-condensable gas from a compressor 9 are sent together to a heating furnace 7 for combustion, and the combustion heat is used to supply heat to the fluidized bed pyrolyzer 4. After the pyrolysis, the light phase components are sent to a gas-solid cyclone separator 5. The resulting gas phase passes through a quench tower 8 to obtain an alkane-and-arene precursor which enters a boiling bed reactor 10 together with dilution oil to undergo hydrogenation reaction. After the boiling bed reaction, the three phases are separated by a three-phase separator. After the separation, the reaction product enters a hot high-pressure separator 11, an air cooler 13, a cold high-pressure separator 14, and a cold low-pressure separator 15 to separate out the partially hydrogenated arenes and alkanes. The circulating oil passes through the hot high-pressure separator 11, and then is sent together with the circulating hydrogen from a compressor 16 to a heating furnace 12 where they are heated and then returned to the boiling bed reactor 10. After heat exchange by a heat exchanger 20, the partially hydrogenated arenes and alkanes enter two-stage fixed bed reactors 17, 19 in sequence to undergo hydrocracking again. A heating furnace 18 is disposed between the two-stage fixed bed reactors. The reaction product passes through the heat exchanger 20, then enters an air cooler 21, and then enters a cold high-pressure separator 22 and a cold low-pressure separator 24 for purification, recovery, and high quality optimization. Then, it's sent to a heating furnace 25 for heating, and then enters a rectification tower 26 to obtain naphtha, jet fuel, light diesel oil and heavy diesel oil by separation. The circulating hydrogen from the cold high-pressure separator 22 is heated by a heating furnace 23 and then circulated to the fixed bed reactor for recycling.

EXAMPLES

The invention will be further illustrated with reference to the following specific Examples. It is nevertheless to be appreciated that these Examples are only intended to exemplify the invention without limiting the scope of the invention. The test methods in the following examples for which no specific conditions are indicated will be carried out generally under conventional conditions or under those conditions suggested by the manufacturers. Unless otherwise specified, all parts are parts by weight, and all percentages are percentages by weight.

Example 1: Method and Apparatus for Treatment of 10,000 Ton Mineralized Refuse/Day In a facility for treating 10,000 ton mineralized refuse/day, an apparatus for hydrocracking mineralized refuse cracked residual oil as shown in FIG. 1 was designed. The specific operation process and effects are described as follows:

After mineralized refuse was recovered by excavation and dried naturally for a certain period of time, the mineralized refuse was crushed with a crusher, and the crushed mineralized refuse was collected into a material tank. Then, it was sent by a screw feeder to a fluidized bed pyrolyzer for carbonization of organic matter. The fixed carbon and ash collected after pyrolysis fell into a separation tank. After separation, the pyrolyzed carbon and the non-condensable gas from a compressor were sent together to a heating furnace for combustion. The combustion heat was used to supply heat to the fluidized bed pyrolyzer. After the pyrolysis, the light phase components were sent to a gas-solid cyclone separator. The resulting gas phase was cooled and liquefied by a quench tower to obtain an alkane-and-arene precursor which entered a boiling bed reactor together with dilution oil to undergo hydrogenation reaction. After the boiling bed reaction, the three phases were separated by a three-phase separator, and the reaction product entered a hot high-pressure separator, an air cooler, a cold high-pressure separator, and a cold low-pressure separator to separate partially hydrogenated arenes and alkanes. Circulating oil passed through the hot high-pressure separator and entered a heating furnace together with circulating hydrogen from the compressor to be heated, and then returned to the boiling bed reactor. After heat exchange in a heat exchanger, the partially hydrogenated arenes and alkanes entered two-stage fixed bed reactors in sequence to undergo hydrocracking reaction again. A heating furnace was disposed between the two-stage fixed bed reactors. The reaction product passed through the heat exchanger to an air cooler, and then entered a cold high-pressure separator and a cold low-pressure separator for purification, recovery, and high quality optimization. Then, it was sent to a heating furnace for heating, and then entered a rectification tower to obtain naphtha, jet fuel, light diesel oil and heavy diesel oil by separation. The circulating hydrogen from the cold high-pressure separator was heated by a heating furnace and then circulated to the fixed bed reactor for recycling.

For the landfill of the domestic waste in the apparatus for hydrocracking mineralized refuse cracked residual oil, the waste pollution was controlled in accordance with the national standard "Pollution Control Standard for Domestic Waste Landfill" GB16889-1997. At the same time, the domestic waste and the ambient air around the hydrogenation unit including the boiling bed and the fixed bed combined in series were sampled and analyzed according to the Air Quality Monitoring Standard GB/T14678-93. The odor intensity and the ammonia and hydrogen concentrations in the surrounding environment of the landfill were measured, respectively. The measured results proved to meet the requirements of experimental operation.

In respect of this domestic waste landfill, with an eye to the amount of mineralized refuse processed over the years, the mineralized refuse processing capacity of the apparatus for hydrocracking mineralized refuse cracked residual oil was designed to be 10,000 tons/day. The screening of the refuse recovered about 45% compostable matter having a purity of 97% or more, 20% compostable matter having a purity of 70-80 wt %, and 25% plastic having a purity of 80% or more. The fluidized bed pyrolyzer was combined with the hydrogenation unit including the boiling bed and the fixed bed combined in series achieved oil recovery at the end.

The components in the cracked oil included: alkanes, arenes, alkenes, phenols, alcohols, ketones, ethers, esters, acids, and aldehydes. The components were complex. After being upgraded by hydrogenation, the main components were arenes (46.44%), alkanes (35.09%) and phenols (8.56%).

After the cracked oil was preliminarily upgraded by hydrogenation, the liquid phase product had a gasoline fraction yield of 55.02%, and a diesel fraction yield of 44.98%. The gasoline fraction has a higher octane number, and can be used as a blend oil.

As can be seen, the method of the present invention achieves efficient recovery of usable components in refuse relatively perfectly, and at the same time enables the recovered oil product to meet the requirements for use. The apparatus of the present invention runs smoothly, is convenient to operate and easy to control, and satisfies the requirement of coordination between industrial production and environmental protection. In the hydrogenation process, a boiling bed and a fixed bed are combined in series to strengthen hydrogenation. At the same time, the catalyst discharged from the boiling bed is purified and recovered with a micro-cyclone extraction washing process. As a result, the repeating utilization factor of the catalyst is improved greatly, and waste of resources is avoided. It can not only reduce the pollution of domestic waste and achieve good social benefits, but it can also gradually restore the large amount of land resources occupied by waste storage, which improves the efficient use of land resources. In addition, it can also obtain an oil phase by hydrocracking, and achieve good economic benefits for the enterprise.

The Examples listed above are only preferred examples in the disclosure, and they are not intended to limit the scope of the disclosure. Equivalent variations and modifications according to the disclosure in the scope of the present application for invention all fall in the technical scope of the disclosure.

All of the documents mentioned in the disclosure are incorporated herein by reference, as if each of them were incorporated herein individually by reference. It is to be further understood that various changes or modifications to the invention can be made by those skilled in the art after reading the above teachings of the invention, and these equivalent variations fall in the scope defined by the accompanying claims of the application as well.

What is claimed is:

1. A method for hydrocracking mineralized refuse cracked oil, comprising the following steps:

(a) Crushing and pyrolyzing mineralized refuse to obtain an arene-and-alkane precursor biomass oil;

(b) Hydrogenating the arene-and-alkane precursor biomass oil obtained in step (a) to obtain a hydrocracking product which is separated to obtain arenes and alkanes; and (c) Recovering and processing the arenes and alkanes obtained in step (b) to produce naphtha, jet fuel, light diesel oil and heavy diesel oil.

2. The method of claim 1, wherein in step (a), the mineralized refuse is stable mineralized refuse having an organic matter content of 9-15 wt % on a solid basis of the mineralized refuse, an ion exchange capacity of 50-150 mEq/100 g dry refuse, and a pH of 6-8.

3. The method of claim 1, wherein in step (a), the mineralized refuse is crushed with a crusher to recover biomass particles which enter a fluidized bed pyrolyzer through a screw feeder for hydrolysis, wherein a light phase is discharged from a top of the fluidized bed pyrolyzer after the pyrolysis, and then subjected to gas-solid separation in a gas-solid cyclone separator, wherein gas is discharged from an overflow port of the gas-solid cyclone separator, and residual carbon formed in the pyrolysis is heated by a heating furnace to provide heat.

4. The method of claim 3, wherein the gas discharged from the overflow port of the gas-solid cyclone separator is cooled and liquefied in a quench tower to generate the arene-and-alkane precursor biomass oil.

5. The method of claim 1, wherein in step (b), the hydrogenation is carried out in a boiling bed reactor and a fixed bed reactor combined in series.

6. The method of claim 1, wherein in step (b), the hydrocracking product obtained is separated into alkanes and arenes by high-pressure separation and low-pressure separation.

7. The method of claim 1, wherein in step (c), the alkanes and arenes obtained in step (b) are recovered, and processed by high-pressure separation and low-pressure separation, and then pass through a heating furnace to a rectification tower for processing to form naphtha oil, jet fuel, light diesel oil and heavy diesel oil.

8. An apparatus for hydrocracking mineralized refuse cracked oil, comprising:

A crusher and a fluidized bed pyrolyzer in communication with the crusher, used to perform step (a): crushing and pyrolyzing mineralized refuse to obtain an arene-and-alkane precursor biomass oil;

A boiling bed reactor in communication with the fluidized bed pyrolyzer, and two-stage fixed bed reactors in communication with the boiling bed reactor, used to perform step (b): hydrogenating the arene-and-alkane precursor biomass oil obtained in step (a) to obtain a hydrocracking product which is separated to obtain arenes and alkanes; and A cold high-pressure separator in communication with the two-stage fixed bed reactors a cold low-pressure separator in communication with the cold high-pressure separator, and a rectification tower in communication with the cold low-pressure separator, used to perform step (c): recovering and processing the arenes and alkanes obtained in step (b) to produce naphtha, jet fuel, light diesel oil and heavy diesel oil.

9. The apparatus of claim 8, wherein the apparatus further comprises:

A material tank, of which an upper part is communicated with the crusher and a lower part is communicated with the fluidized bed pyrolyzer through a screw feeder, for collecting crushed mineralized refuse, wherein the screw feeder has an installation angle of 4.30°-6.0°, and a ratio of a rotation speed to a limit rotation speed is 0.4-0.6;

A gas-solid cyclone separator in communication with the fluidized bed pyrolyzer, used for gas-solid separation of a light phase obtained after pyrolysis in the fluidized bed pyrolyzer; a quench tower in communication with an upper part of the gas-solid cyclone separator, used for cooling and liquefying a gas discharged from an overflow port of the gas-solid cyclone separator to form an alkane-and-arene precursor biomass oil; and a separation tank in communication with a lower part of the gas-solid cyclone separator, used for collecting residual pyrolyzed carbon;

A heating furnace in communication with a lower part of the separation tank, used for heating the residual pyrolyzed carbon and non-condensable gas sent from a compressor in communication therewith to supply heat to the fluidized bed pyrolyzer in communication therewith, wherein an upper part of the quench tower is communicated with the heating furnace through the compressor, and the quenching tower cools and liquefies the resulting alkane-and-arene precursor biomass oil which is then sent to the boiling bed reactor in communication therewith for hydrogenation reaction;

A hot high-pressure separator and a heating furnace in communication with the boiling bed reactor, wherein the hot high-pressure separator and the heating furnace are communicated with each other; an air cooler in communication with the hot high-pressure separator; a cold high-pressure separator in communication with the air cooler; a compressor in communication with the cold high-pressure separator and the heating furnace; a cold low-pressure separator in communication with the hot high-pressure separator and the cold high-pressure separator; and a heat exchanger in communication with the cold low-pressure separator, wherein the hot high-pressure separator, the cold high-pressure separator and the cold low-pressure separator, are used for separating the hydrocracking product obtained in the boiling bed reactor to obtain arenes and alkanes; and wherein the heating furnace is used for heating circulating oil in the boiling bed reactor;

A heating furnace disposed between the two-stage fixed bed reactors wherein the heat exchanger is communicated with the two-stage fixed bed reactors respectively; an air cooler in communication with the heat exchanger; a cold high-pressure separator in communication with the air cooler; and a cold low-pressure separator in communication with the cold high-pressure separator which is communicated with a heating furnace, wherein the cold high-pressure separator is communicated with the two-stage fixed bed reactors through the heating furnace; and A heating furnace disposed between the cold low-pressure separator and a rectification tower.

* * * * *